US005237949A

United States Patent [19]

Stevens et al.

[11] Patent Number: 5,237,949

[45] Date of Patent: Aug. 24, 1993

[54] FLOATING PLATFORM SHALLOW DRAFT HULL/DECK MATING

[75] Inventors: James W. Stevens, Houston; Lee K. Brasted, Kingwood, both of Tex.

[73] Assignee: Shell Offshore Inc., Houston, Tex.

[21] Appl. No.: 891,325

[22] Filed: May 29, 1992

[51] Int. Cl.[5] ..... E02B 17/00

[52] U.S. Cl. ..... 114/265; 405/204

[58] Field of Search ..... 114/65 R, 77 R, 79 R, 114/356, 264, 265, 266; 405/195.1, 203-207

[56] References Cited

U.S. PATENT DOCUMENTS

| | | | |
|---|---|---|---|
| 2,598,329 | 5/1952 | Wilson | 405/204 |
| 4,193,714 | 3/1980 | Gjerde | 405/195.1 |
| 4,534,678 | 9/1985 | Nakazato et al. | 405/204 |
| 4,629,365 | 12/1986 | Kuriiwa | 405/204 |

*Primary Examiner*—Edwin L. Swinehart

[57] ABSTRACT

A method for building and assembling an offshore platform whose normal draft exceeds the depth of waterways between the building site and use location of the platform. The hull and deck of the platform are built separately in a shallow graving dock. The deck is then elevated, the graving dock partially flooded and the hull floated into position and mated to the deck. A modified form of the invention is the building of the hull and deck as a single structure and use of the barge to support a portion of the weight of the platform. The graving dock is then flooded to maximum depth, a barge is floated under the deck and ballasted down to a select draft. The barge is attached to the deck and then deballasted to partially support the platform structure and reduce its overall draft.

8 Claims, 2 Drawing Sheets

FLOATING PLATFORM SHALLOW DRAFT HULL/DECK MATING

BACKGROUND OF THE INVENTION

The present invention relates to offshore structures used in the petroleum industry and particularly to floating structures, for example, some semi-submersible drilling vessels or floating platforms that are used for production platforms. An example of a floating production platform would be a tension leg platform used to develop fields that are located in water depths beyond the economic feasibility of fixed leg platforms.

Floating platforms, used for production or drilling and production of a deepwater field, may have relatively deep drafts, for example in excess of 45 feet. The deep draft of these vessels limits the areas of the world in which the vessels can be fabricated, since the launching of the vessel requires a deepwater facility. One solution to the requirement of a deepwater building facility has been to build the hull and the deck components separately and then assemble them in a deepwater location. In this procedure, the hull is fabricated and towed to a deepwater location. The deck is separately fabricated and loaded on a suitable barge and towed to the deepwater location. The hull is then ballasted and submerged until only the uppermost portion of the supporting columns extend above the surface. The deck is then maneuvered into place over the support columns and the hull deballasted to raise it so that the columns can engage the deck and lift the deck from the barge. The deck barge may also be ballasted down as a part of this process to aid in the load transfer. The barge is then removed from between the support columns of the hull and the attachment of the hull to the deck completed. This type of procedure is described in U.S. Pat. No. 3,797,438 where the hull and deck are built separately and then assembled in a deepwater location.

While the method has been used to assemble the hull and deck of semi-submersibles and other offshore structures, it is extremely difficult and involves risk to both the equipment and the personnel carrying out the work. It can be readily appreciated that any wave, current or wind forces that cause either the hull or the barge transporting the deck to move can lead to damage to the other structure if they collide as a result of the movement. For example, any rise or fall of the deck of even a few inches can cause severe damage to the supporting columns on the hull as it is being deballasted to raise the columns into engagement with the deck. In addition, the problem of accurately aligning the support structure with the support columns on the hull involves considerable time and effort. Various structures with procedures for use have been developed to cushion or absorb some of the shock of the mating of the hull and deck in these operations. For example, U.S. Pat. No. 4,848,967 describes a shock absorbing system that is used reduce the shock as an integrated deck structure is lowered onto a fixed offshore platform substructure. As shown in the '967 patent, the deck is transported by a barge which is then ballasted to lower the deck structure onto the substructure.

At the present time, there is considerable interest in developing deepwater petroleum reserves in the Gulf of Mexico. This development requires the use of tension leg platforms which normally have a draft of greater than 45 feet. Most of the waterways in the Gulf area are limited to a 40-foot depth and thus the structure cannot be assembled in a building yard and towed to the desired location as a completely assembled unit. In order to build a structure in the Gulf area it is necessary to build the deck and the hull separately and tow each unit to a deepwater location. The depth must be sufficient to allow submerging of hull structure and the floating of the deck structure onto the support columns of the hull as described above. This requires a considerable period of good weather to complete the assembly to the stage necessary for the structure to float freely as a unit. Considerable time can be lost while waiting for a suitable weather pattern to develop that will allow assembly of the structure in the deepwater location.

SUMMARY OF THE INVENTION

The present invention solves the above problems by providing a procedure by which the deck and hull of a floating offshore structure can be built and assembled in the Gulf Coast area and transported to a use location using waterways having a limited depth. Normally, waterways in the Gulf area have a depth of at least 40 feet. Suitable building sites are available that either connect with these waterways or are accessible through deepwater passages. Alternatively, passages can be dredged to provide a 40-foot overall depth. The present invention is designed to fabricate a floating structure completely at the building site and then transport it over these waterways to the open Gulf of Mexico.

The method of the invention comprises first dredging a graving dock having a depth at least equal to the depth of the waterways, for example 40 feet in the case of the Gulf Coast area. The hull and deck structure are then built in the graving dock as separate units. After the hull and deck structure are built, the deck is elevated by suitable jacking means to a height which will permit floating the hull structure under the deck. The graving dock is then flooded to a sufficient depth to allow the hull structure to be floated under the deck structure and the deck structure then lowered onto the hull structure to sink the hull structure into contact with the bottom of the graving dock. The graving dock can then be emptied or the shallow water allowed to remain in the graving dock while the assembly of the deck to the hull is completed. After assembly and completion of all details of the structure, the graving dock is flooded to its maximum depth. A barge having support columns fabricated on its deck is then ballasted so that it can pass under the deck and between the support columns of the hull. After the barge is in position, the support columns are raised until they contact the deck structure and support a portion of the overall weight of the structure. This is accomplished by deballasting the barge. The barge supports sufficient weight so that the overall draft of the structure is reduced below the depth of the waterways that connect with the open Gulf. In the Gulf Coast area, this is approximately 38 feet, which would allow safe towing of the structure to the open Gulf through the connecting waterways.

An alternate construction to the above described method would be to build the hull and deck structure as a single unit. After the hull and deck are completed the graving dock can be flooded to its maximum depth. The barge can then be positioned under the deck, the support columns raised and the barge deballasted to support a portion of the weight of the structure. While this alternate method simplifies construction of the structure, it requires more time since the hull and deck cannot be constructed simultaneously.

BRIEF DESCRIPTION OF THE DRAWINGS

The present invention will be more easily understood from the following detailed description when taken in conjunction with the attached drawings in which.

DESCRIPTION OF THE PREFERRED EMBODIMENT

Figure 1:
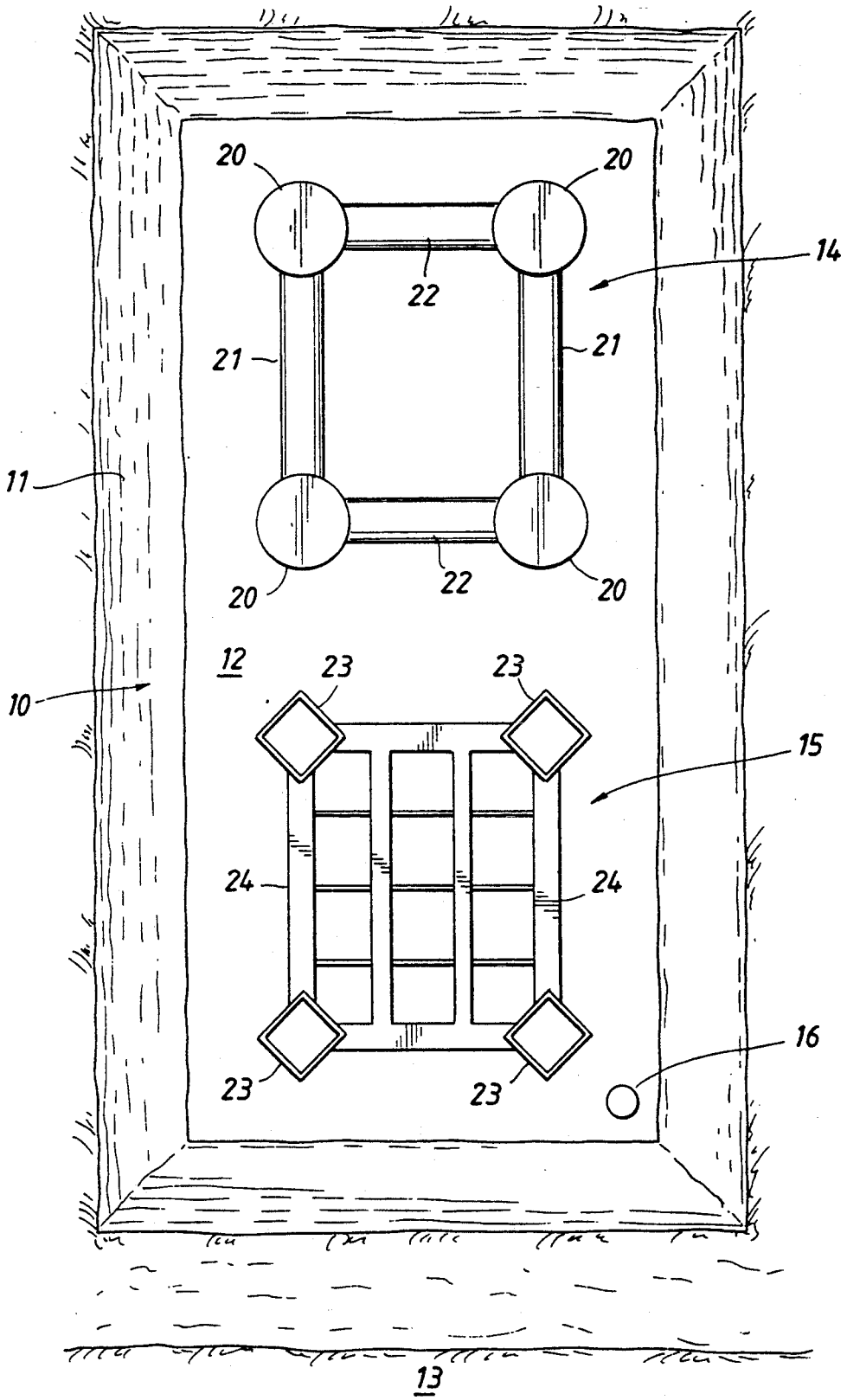
FIG. 1 is a plan view of the graving dock showing the hull and deck structure therein.

Referring now to FIG. 1, there is shown a graving dock 10 which has suitable side walls 11 and a floor 12. The graving dock can be excavated in suitable land adjacent a waterway 13 which has suitable depth to the open Gulf. The graving dock sides 11 should have sufficient slope to prevent caving when the dock is refilled to attach the deck to the hull. In addition, it may be desirable to provide a sump 16 in one or more locations for removing water which could enter the graving dock through the earthen walls or due to rainfall.

The hull structure 14 is assembled at one end of the graving dock while the deck structure 15 is assembled at the other end of the graving dock. As shown, the hull structure comprises four vertical columns 20 that are connected together by side pontoons 21 and end pontoons 22. An example of a typical tension leg platform would have the columns spaced on centers of approximately 200 by 250 feet and both the hull and deck could be built in a graving dock 450 feet wide by 1000 feet long by 40 feet deep. The deck structure has four structures 23 disposed at the corners thereof which are connected together by a suitable grid structure 24. Both the hull and the deck structure can be completely fabricated in the graving dock and all major components installed.

Figure 2:
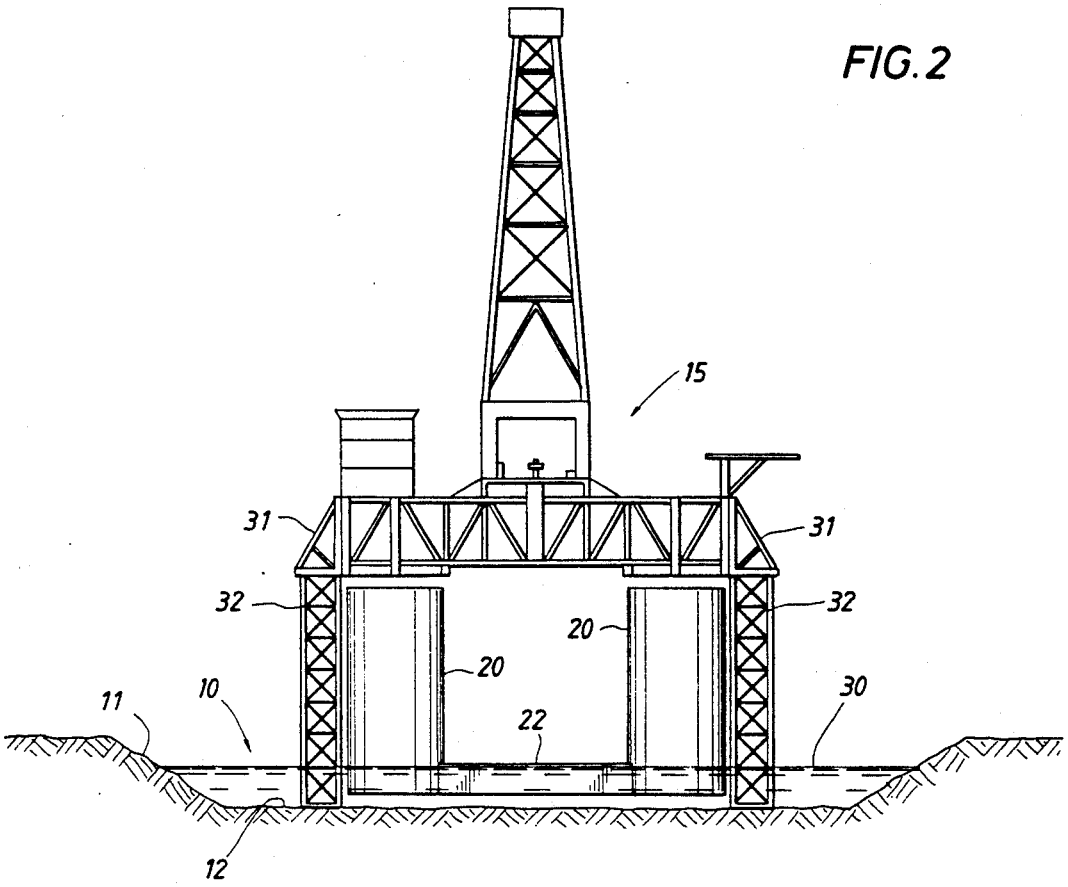
FIG. 2 is an elevation view of the deck structure elevated and the hull being floated underneath the deck structure.

Referring now to FIG. 2, after the deck is completed and all major components have been installed, including the drilling rig, the assembly is elevated to a height that will allow floating of the hull structure under the deck. As shown in FIG. 2, temporary supports 31 can be attached to the corners of the deck structure and jacking towers 32 used to elevate the deck structure. After the deck structure is elevated, the graving dock is partially flooded as indicated by the water level 30. This depth is normally considerably less than the overall depth of the graving dock, for example, a 25-foot depth when the graving dock has an overall depth of 40 feet. This would provide sufficient water depth to float a hull structure that is provided with support columns 20 approximately 70 feet in diameter and pontoons 21 and 22 with a cross sectional area of approximately 25 feet high×35 feet wide. In a typical offshore structure with all of the pump equipment and piping and other accessories installed in the support columns, this hull would have a light displacement of 20,000 tons that is easily floated in a 25-foot water depth. After the hull is floated, it can be maneuvered under the elevated deck structure. Since the assembly is taking place in a small graving dock, weather will not interfere with the maneuvering of the hull structure or the mating of the deck to the hull. The hull can be mated to the deck by lowering the jacking means 32 until the deck contacts the support columns 20. Further lowering of the deck will then cause the hull to submerge until the pontoons and the bottom of the columns are resting on the floor of the graving dock. The graving dock can then be pumped out or the water allowed to remain in the graving dock.

After the deck has been lowered onto the hull, the attachment of the deck to the hull structure can be completed and all of the other electrical, mechanical, and other connections between the deck and equipment located in the hull can be completed. Likewise, any additional equipment can be installed and the completed platform made ready for operation.

Figure 3:
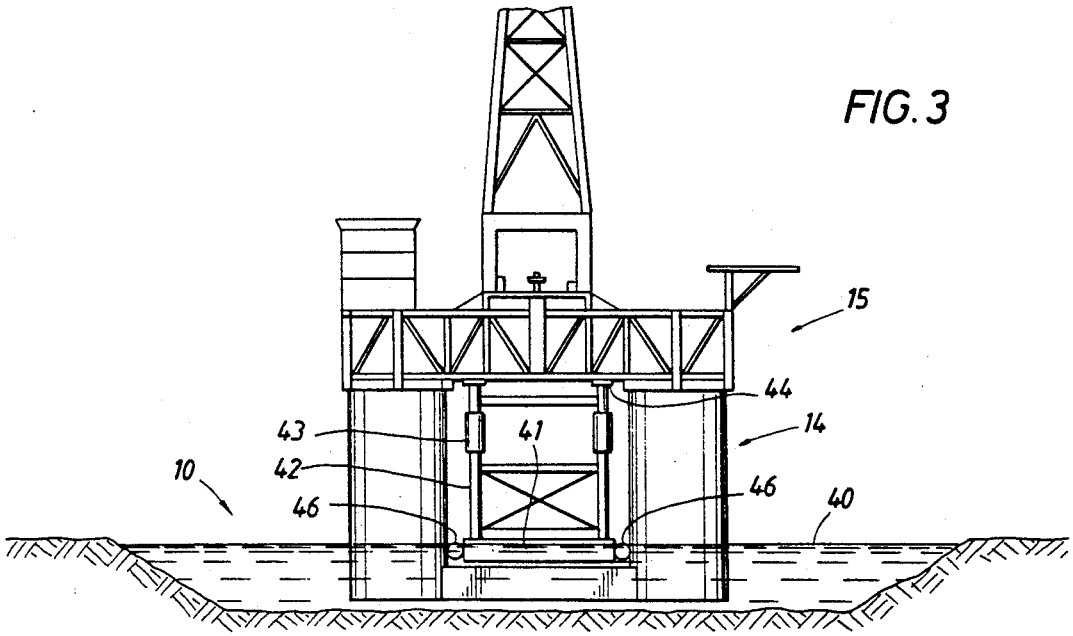
FIG. 3 is an elevation view of the hull and deck structure connected to each other and the barge positioned to support a portion of the total weight of the structure.

After the platform is completed, the graving dock is flooded to its maximum depth as shown by the water level 40 in FIG. 3, for example 40 feet in the above example. The structure described above including the deck structure has a normal design draft of 45 feet in a light displacement condition. As often occurs during construction, additional equipment is added to the platform and will increase its displacement until its nominal light draft is as much as 50 feet or more. The present invention reduces the draft of the structure by partially supporting the structure with a camel barge 41. The barge 41 is floated into the graving dock through an opening between the graving dock and the waterway 13 shown in FIG. 1. The barge structure is provided with columns 42 for supporting the deck structure. Suitable jacks 43, for example sand jacks, are included in the support columns so that the barge may be removed from the platform after it is transported to a deepwater location. The barge is normally ballasted to near its maximum draft and then positioned under the deck structure as shown in FIG. 3. The columns 42 are then raised until the pads 44 at the top of the columns contact the underside of the deck structure 15. The barge is then deballasted until it supplies a buoyancy sufficient to reduce the overall draft of the platform to less than the depth of the waterways. In the example given, 38 feet was adequate to supply sufficient clearance to tow the platform to a deepwater location. In addition, it may be desirable to place suitable fenders 46 at the sides of the barge to prevent it from damaging the support columns of the hull.

After the platform is partially supported by the barge to reduce its overall draft, it can be towed from the graving dock down connecting waterways into the open Gulf. Once the platform reaches the open Gulf and sufficient water depth is available to support the platform at its normal draft, the jacks 43 may be actuated to lower the platform to its designed draft. In some cases, it may be necessary also to ballast the barge to a deeper draft so that the upper end of the support columns 42 on the barge clear the lower surface of the deck. Once suitable clearance is provided, the barge can be removed from the platform and the platform towed to its final position.

From the above description of the preferred embodiment, it is appreciated that the platform was completely built and assembled in sheltered inland waters and then towed to the open Gulf as a completed unit. This eliminates the need to install the deck on the hull in open Gulf waters. Further, by completing the platform in inland waters with the platform resting on the floor of the graving dock it is possible to make all the necessary connections between the deck and the hull structure and test all of the installed equipment. This greatly reduces the time required for completing the platform offshore and placing it in operation. In the case where the deck is merged with the hull in an offshore location, considerable time is required to complete the offshore structure and test all of the equipment.

The above method can also be used to assemble an offshore platform in sheltered inland waters where the hull and the deck are built at separate locations. To accomplish this, the hull is first positioned in water having a depth at least equal to the average depth of the waterways connecting with the open Gulf, for example 40 feet. The hull is then ballasted until it rests on the floor of the waterway or other assembly location. The deck supported on a barge by suitable columns as shown in FIGS. 2 and 3 and floated over the hull columns. The barge can then be ballasted and/or the hull deballasted to join the deck onto the hull. In addition, the support columns on the barge can also be lowered to lower the deck onto the hull. After completion of merging the deck and the hull, the barge can be deballasted to partially support the weight of the completed platform and thus reduce its draft as described above.

While this method is feasible, it can only be accomplished in sheltered inshore waters since a deck supported high enough above the deck of a barge to allow assembly of the two structures as described has very limited stability. In view of the limited stability of such a system, it is preferred to utilize the method described with the reference to FIGS. 1–3 in assembling the deck onto the hull.

As described above, it is also possible to build the hull 14 and deck 15 as a single unit. After the platform is completed with all of the equipment installed, the graving dock 10 is flooded to its maximum depth. The ballasted camel barge 41 can then be positioned under the deck and the support columns 42 raised until the pads 44 contact the bottom of the deck. The barge can then be deballasted to support a portion of the weight of the structure to reduce the overall draft to acceptable limits.

What is claimed is:

1. A method for building and assembling a floating platform whose normal draft exceeds the depth of the waterways connecting the building site with the final location of the platform, said method comprising:

building separately, the hull and deck portions of the platform in a graving dock, said hull including a plurality of spaced columns that extend upwardly to support said deck;

elevating the deck;

partially flooding the dock;

floating the hull under the elevated deck;

lowering the deck onto the hull, forcing the hull to ground, and completing the attachment of the deck to the hull to complete the assembly of the platform;

flooding the dock completely;

floating a barge under the deck and between the spaced columns; and support part of the weight of the assembled platform using said barge until the draft of the platform is less than the depth of the waterways.

2. The method of claim 1 wherein said barge is provided with support columns for engaging said deck from said barge to support a portion of the weight of the platform.

3. The method of claim 2 wherein said support columns include jacking means that can be lowered when the platform is moved to deep water.

4. The method of claim 3 and in addition towing the platform to a deepwater location, ballasting the hull to a draft at least as deep as its normal draft, lowering said jacking means to separate said barge from said deck and removing said barge.

5. A method for building and assembling a floating platform whose normal draft exceeds the depth of the waterways connecting the building site with the final location of the platform said method comprising:

building the hull and deck portions of the platform in a graving dock, said hull including a plurality of spaced columns that extend upwardly to support said deck;

after completion of the platform, flooding the graving dock to its maximum depth;

floating a barge under the deck and between the spaced columns; and supporting part of the weight of the assembled platform using said barge until the draft of the platform is less than the depth of the waterway connecting the graving dock to the final location of the platform.

6. The method of claim 5 wherein said barge is provided with support column for engaging the deck of the platform to support a portion of the weight of the platform.

7. The method of claim 1 wherein said spaced columns comprise four corner columns connected together at their lower end by pontoon members, said pontoon members being submerged when the platform is floating at its normal draft.

8. The method of claim 7 wherein the depth of the pontoons is less than the normal draft of the platforms.

* * * * *